US005771812A

United States Patent [19]

Britzke

[11] Patent Number: 5,771,812

[45] Date of Patent: Jun. 30, 1998

[54] ARTICULATED GANGWAY

[75] Inventor: Ingo Britzke, Kassel, Germany

[73] Assignee: Hubner Gummi-Und Kunststoff GmbH, Kassel, Germany

[21] Appl. No.: 757,836

[22] Filed: Nov. 27, 1996

Related U.S. Application Data

[63] Continuation of PCT/DE95/00876, Jul. 6, 1995.

[51] Int. Cl. [6] ..... B61D 49/00

[52] U.S. Cl. ..... 105/458; 105/8.1; 105/3

[58] Field of Search ..... 105/3, 458, 459, 105/8.1; 296/57.1; 414/340, 343

[56] References Cited

U.S. PATENT DOCUMENTS

| | | | |
|---|---|---|---|
| 163,048 | 5/1875 | Campbell | 105/458 |
| 302,550 | 7/1884 | Ferguson | 105/458 |
| 701,202 | 5/1902 | Holland et al. | 105/458 |
| 5,010,614 | 4/1991 | Braemert et al. | 105/458 |

FOREIGN PATENT DOCUMENTS

| | | | |
|---|---|---|---|
| 0257185 | 3/1988 | European Pat. Off. . | |
| 0583491 | 2/1994 | European Pat. Off. . | |
| 3305062 | 8/1984 | Germany . | |
| 9304505 | 9/1994 | Germany . | |
| 39399 | 3/1907 | Switzerland | 105/458 |
| 2047186 | 11/1980 | United Kingdom | 105/458 |

*Primary Examiner*—Mark T. Le
*Attorney, Agent, or Firm*—Thomas R. Vigil

[57] ABSTRACT

The articulated gangway forming part of a corridor between two vehicles or vehicle parts hinged together comprises: two or more stepping and gliding members which are hinged to each other; supporting elements between the stepping and gliding members, the stepping and gliding members being located generally parallel to the longitudinal axis of the supporting elements and are movable by the supporting elements; and coiled spring elements on the supporting elements and between adjacent stepping and gliding members to return the stepping and gliding members to their original position after the articulated gangway has gone through a cornering maneuver.

9 Claims, 2 Drawing Sheets

ARTICULATED GANGWAY

CROSS-REFERENCE TO RELATED APPLICATIONS

This is a Continuation of International Application PCT/DE 95/00876 with an international filing date of Jul. 6, 1995, now abandoned.

BACKGROUND OF THE INVENTION

1. Field of the Invention

The present invention relates to an articulated gangway for a corridor between two vehicles hinged to each other. The gangway comprises several stepping and gliding members which are hinged to each other.

2. Description of the Related Art

A corridor between two vehicles, for example, between train coaches or between vehicle parts of an articulated bus, comprise a connecting corridor, which can be designed as an articulated gangway, and a pleated or undulated bellows encompassing the articulated gangway. Such corridors present the advantage that they can yield to all occurring movements of the vehicle.

An articulated gangway for a corridor is known, for example, from EP-A published patent application 0 583 491. But this articulated gangway is relatively complicated in its structure and thus expensive.

Another prior art intercommunicating gangway is disclosed in published EP-A 0 257 185.

SUMMARY OF THE INVENTION

One object of the present invention is to provide an articulated gangway which is able to yield to all occurring movements of two vehicles or vehicle parts hinged together on one side and which moreover is inexpensive, easy to manufacture and nevertheless extremely lasting.

A solution to this object is obtained by providing supporting elements and stepping and gliding members which are located parallel to the longitudinal axis of the supporting elements and can be received by them. The stepping and gliding members are elastically slidable relative to each other, whereas the supporting elements are maintained by the vehicles hinged together. That is to say that the stepping and gliding members overlapping each other are guided slidably by the supporting elements parallel to the longitudinal axis of the supporting elements. Thus, the articulated gangway according to the invention comprises only a few components which are easy to manufacture, rendering the production costs of the articulated gangway affordable. The support for the gliding and stepping members constituting the articulated gangway is guaranteed by the two preferably parallel running supporting elements, whereas the supporting elements themselves are, as stated above, received by the coach bodies of the vehicles, respectively, in such a way that they can enter completely into the coach bodies, when the members are pushed together during cornering. The supporting elements are positioned into the coach bodies of the vehicles, respectively, in such a way that they are able to yield to the occurring swaying and nodding movements.

In order to guarantee that the stepping and gliding members come back into their original position after excursion, e.g. during cornering, it has been foreseen that the members located on the supporting elements are propped against each other by coiled springy elements which surround the supporting elements. In order to avoid a gap between the stepping and gliding members, movement limiting structure is provided to delimit the shifting way of each single stepping and gliding member relative to each other on the supporting elements. The limiting structure includes a connecting line which can, for example, be a rope connecting the stepping and gliding members and whose length between the different members is limited so that even in their maximally spaced position the stepping and gliding members still are slightly overlapping.

Further, the last member in a row of stepping and gliding members forming the gangway is designed to be connectable to the coach body of one of the vehicles (or the vehicle part), so that the articulated gangway can be linked to the coach body.

The supporting element is designed as a rod. The stepping and gliding members have advantageously a t-shaped profile including a web which can be connected to the supporting elements. The web has a perpendicularly running flange serving as a stepping or gliding surface. The webs of the stepping and gliding members have holes for receiving the supporting elements designed, accordingly, as rods with a circular section.

In order to reduce the wear and tear by the relative motion of the different stepping and gliding members to each other, either the stepping or gliding members are made advantageously of wear proof synthetic material. Such an articulated gangway can also be used in an articulated vehicle in which the turning knuckle is located in the area of the articulated gangway, especially in the middle between the two vehicles underneath the articulated gangway, whereby, the central member is then advantageously fixed onto the supporting elements.

DESCRIPTION OF THE PREFERRED EMBODIMENT(S)

Figure 1:
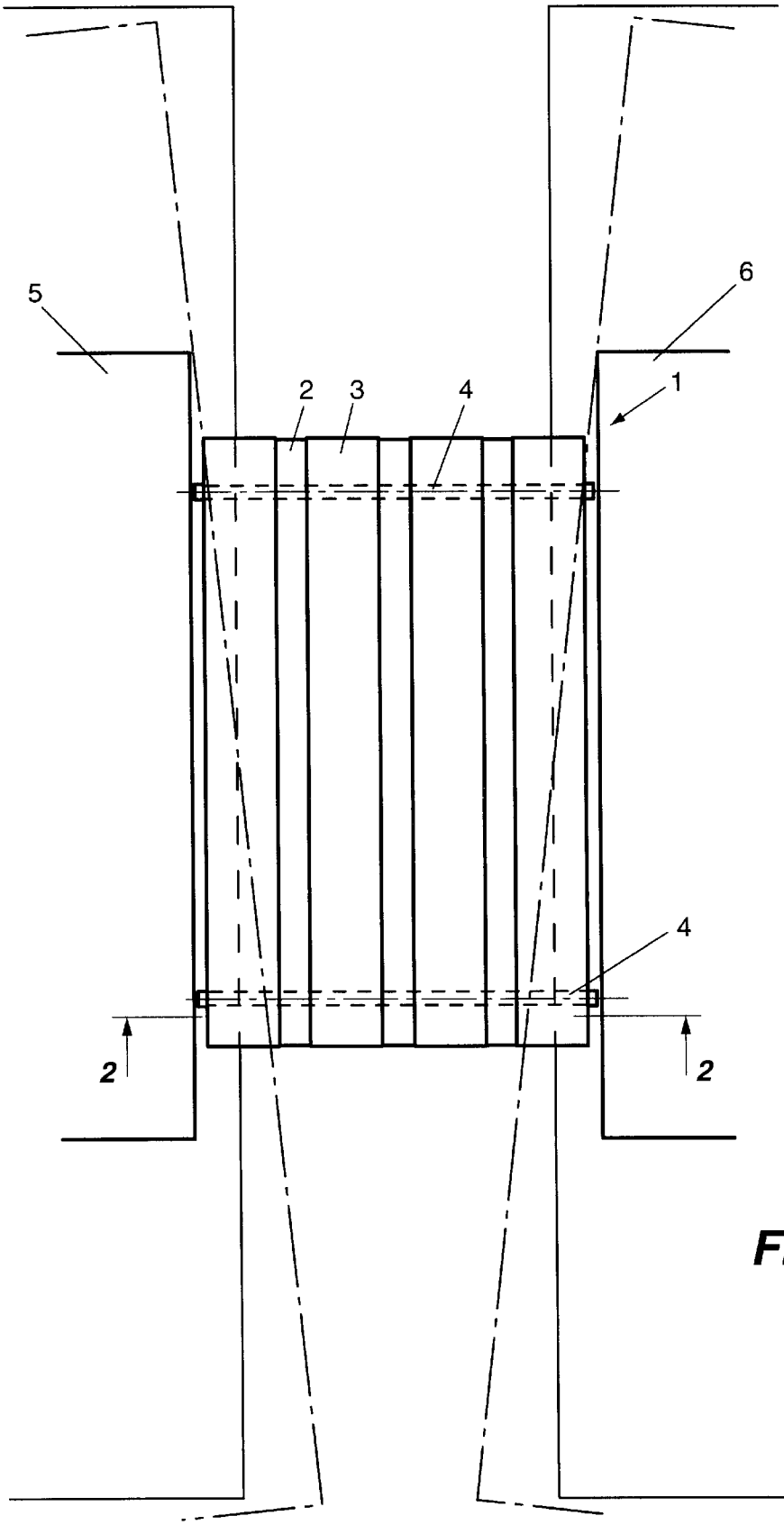
FIG. 1 is a top view of the articulated gangway.

FIG. 1 is a diagrammatic view of an articulated gangway 1 which comprises stepping members 2 and gliding members 3 arranged in between the stepping members 2. The T-shaped stepping and gliding members 2, 3 are maintained parallel to each other by running supporting elements 4, which are located in the schematically suggested coach bodies 5, 6. Thus, the stepping and gliding members 2, 3 can be received transversely to the longitudinal axis of the vehicle by the supporting elements 4 running parallel to the longitudinal axis of the vehicle and being maintained or supported by the vehicles, respectively.

Figure 2:
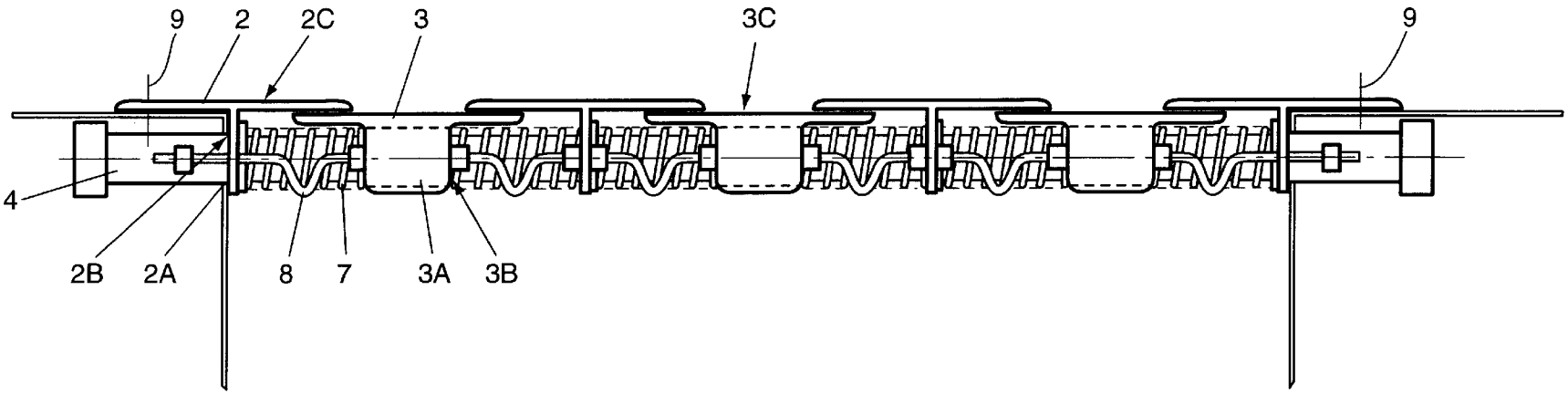
FIG. 2 is a view along the line II—II of FIG. 1.

FIG. 2 shows in detail the design of the articulated gangway; the supporting elements being identified with reference to numeral 4 which receives the t-shaped stepping and gliding members 2, 3. The webs 2*a* and 3*a*, respectively, of the t-shaped stepping and gliding members have a hole 2*b* and 3*b*, respectively, for receiving the supporting element 4. This supporting element 4 having advantageously, a round cross section. In between the webs 2*a* and 3*a*, coiled spring elements 7 are provided, whose function it is, to bring back into their original position, the different stepping and gliding members 2, 3 after an excursion of the articulated gangway, as shown in dashes in FIG. 1.

In order to avoid that during such an excursion the stepping members 2 do not overlap the gliding members 3, a movement limiting structure 8 is provided. This limiting structure 8, for example, a wire rope, connects the webs 2*a*, 3*a* of each stepping and gliding member 2, 3. The length of the wire rope 8 serving to limit movement between the different webs or members, is such that even in case of a maximal excursion of the stepping and gliding members, respectively, they still overlap each other up to a certain point.

The fixing of the gangway is achieved on one side by locating the rod shaped supporting elements 4 in the coach bodies, and on the other hand by fixing the last stepping member 2 onto the coach body by means of a bolt and nut connection 9. In the area of this last stepping member 2, the gangway lies on a bearing of the coach body. The central gliding member 3, that's to say the member located in the middle of the length of the supporting elements 4, is fixed when the turning knuckle (not shown), between both vehicles is located exactly in the center between two vehicles.

I claim:

1. An articulated gangway of a corridor between two vehicles hinged to each other, said gangway comprising at least two stepping and gliding members which overlap each other, said stepping and gliding members being slidably supported for movement relative to each other on common support members (4), the stepping and gliding members (2, 3) being arranged for movements in a direction parallel to the longitudinal axes of the supporting members (4), the support members (4) being held by the vehicles, and the stepping and sliding members (2) being located on the support members (4) and propped up against each other by coiled spring elements surrounding each one of said support elements (4).

2. The articulated gangway accordingly to claim 1, characterized in that the stepping and gliding member (2) located at one end of the at least two stepping and gliding members (2, 3) is connected with a coach body (5, 6) on one of the vehicles.

3. The articulated gangway according to claim 1, characterized in that each one of the support members (4) is constructed as a rod.

4. The articulated gangway according to claim 1, characterized in that the stepping and gliding members are arranged for movements in a shifting path and that a limiting means (8) is provided for delimiting the shifting path of the movement of the stepping and gliding members (2, 3) on the support members (4).

5. The articulated gangway according to claim 1 characterized in that a central guiding element (3) is fixed onto the support members (4).

6. The articulated gangway according to claim 1, characterized in that the stepping and gliding members (2, 3) are T-shaped, and include webs (2*a*, 3*a*) which are connected to the support members (4) and each of said stepping and gliding members (2, 3) has a flange (2*c*, 3*c*) running perpendicular to said web (2*a*, 3).

7. The articulated gangway according to claim 6, characterized in that the webs (2*a*, 3*a*) of the stepping and gliding members (2, 3) have holes (2*b*, 3*b*) for mounting the webs (2*a*, 3) to the support members (4).

8. The articulated gangway according to claim 1, characterized in that at least one of the stepping and gliding members (2, 3) is made of wear-proof synthetic material.

9. The articulated gangway according to claim 1, characterized in that the stepping and gliding members (2, 3) are received transversely to the longitudinal axis of at least one of the vehicles by the support members (4) running parallel to the longitudinal axis of said at least one of the vehicles and are supported by said at least one of the vehicles.

* * * * *